US012320610B2

(12) United States Patent
Lee et al.

(10) Patent No.: US 12,320,610 B2
(45) **Date of Patent: *Jun. 3, 2025**

(54) COVER KIT FOR FIREARM HANDGUARD

(71) Applicants: Shanyao Lee, Santa Ana, CA (US); Shih Ting Hung, Santa Ana, CA (US)

(72) Inventors: Shanyao Lee, Santa Ana, CA (US); Shih Ting Hung, Santa Ana, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/352,257

(22) Filed: Jun. 19, 2021

(65) Prior Publication Data

US 2022/0404114 A1 Dec. 22, 2022

(51) Int. Cl.
*F41A 35/00* (2006.01)
*F41C 23/16* (2006.01)

(52) U.S. Cl.
CPC ..... *F41A 35/00* (2013.01); *F41C 23/16* (2013.01)

(58) Field of Classification Search
CPC ..... F41A 35/00; F41C 23/16; F41C 27/00
See application file for complete search history.

(56) References Cited

U.S. PATENT DOCUMENTS 6,568,118 B1 * 5/2003 Teetzel ..... F41G 1/48 42/105
6,782,652 B1 * 8/2004 Erickson ..... F41A 35/02 42/143
7,199,315 B1 * 4/2007 Sharrah ..... F41G 1/34 200/61.43
7,243,454 B1 * 7/2007 Cahill ..... F41C 23/16 42/72
7,627,975 B1 * 12/2009 Hines ..... F41G 11/003 42/84
7,845,105 B1 * 12/2010 Cahill ..... F41C 27/00 42/117
8,091,265 B1 * 1/2012 Teetzel ..... F41C 23/16 42/71.01
8,146,282 B2 * 4/2012 Cabahug ..... F41C 23/22 42/72
8,225,544 B2 * 7/2012 Darian ..... F41C 23/22 42/84
8,322,064 B2 * 12/2012 Cabahug ..... F41C 27/00 42/71.01
8,429,845 B1 * 4/2013 Swan ..... F41G 11/002 42/71.01
8,443,539 B2 * 5/2013 Cabahug ..... F41G 11/003 42/71.01
8,850,735 B2 * 10/2014 Kenney ..... F41A 3/66 42/106
8,875,434 B2 * 11/2014 Michal ..... F41C 27/00 42/96

(Continued)

*Primary Examiner* — Michelle Clement
(74) *Attorney, Agent, or Firm* — Ying-Ting Chen; Law Office of Michael Chen

(57) ABSTRACT

A cover kit for a firearm handguard having a plurality of slots, the cover kit includes a bottom side detachably mounted on the slot of the firearm handguard; fastening means for securing the cover body to cover the slot on the firearm handguard; a cable secured between the bottom side of the cover body and the firearm handguard; wherein the bottom side comprises a plurality of horizontal tunnels and a plurality of transversal tunnels intersected with the transversal tunnels; wherein the cable is embedded in at least one of transversal tunnel and/or the horizontal tunnels.

19 Claims, 6 Drawing Sheets

(56) References Cited

U.S. PATENT DOCUMENTS 9,200,867 B1 * 12/2015 Swan ..... F41C 23/16
9,488,436 B2 * 11/2016 Abst ..... F41G 11/003
9,823,043 B2 * 11/2017 Compton ..... F41C 27/00
9,829,274 B2 * 11/2017 Vallo ..... F41C 23/18
9,891,023 B2 * 2/2018 Compton ..... H02J 7/025
9,897,411 B2 * 2/2018 Compton ..... F41G 11/00
9,921,028 B2 * 3/2018 Compton ..... H04B 5/0037
10,082,363 B2 * 9/2018 Burgess ..... F41G 11/003
10,337,834 B2 * 7/2019 Downing ..... F41G 9/00
10,337,836 B2 * 7/2019 Righi ..... F41G 11/003
10,386,148 B1 * 8/2019 Handrick ..... F41A 21/44
10,458,754 B2 * 10/2019 Miller ..... F41G 11/003
10,514,235 B1 * 12/2019 McCauley ..... H01H 9/02
10,663,261 B2 * 5/2020 Summerfield ..... F41G 11/003
10,876,814 B1 * 12/2020 Visser ..... F41C 23/22
11,175,114 B1 * 11/2021 Lee ..... F16L 3/02
2007/0235298 A1 * 10/2007 Kim ..... F41G 1/34
200/18
2009/0241397 A1 * 10/2009 Fitzpatrick ..... F41C 23/16
42/90
2010/0083553 A1 * 4/2010 Montgomery ..... F41C 27/00
42/84
2010/0192446 A1 * 8/2010 Darian ..... F41G 11/003
320/108
2010/0192448 A1 * 8/2010 Darian ..... F41G 11/003
42/84
2010/0287809 A1 * 11/2010 Williams ..... F41G 11/003
42/90
2011/0000120 A1 * 1/2011 Thompson ..... F41C 27/00
42/84
2011/0131858 A1 * 6/2011 Darian ..... F41G 11/003
42/90
2011/0214328 A1 * 9/2011 Williams ..... F41G 11/003
42/90
2012/0085013 A1 * 4/2012 Cahill ..... F41C 27/00
42/96
2012/0266514 A1 * 10/2012 Michal ..... F41C 23/18
42/90
2014/0000142 A1 * 1/2014 Patel ..... F41A 11/02
42/14
2014/0076146 A1 * 3/2014 Gomez ..... F41A 21/48
89/191.01
2014/0115936 A1 * 5/2014 Kenney ..... F41G 11/003
42/16
2014/0223794 A1 * 8/2014 Brown ..... F41C 23/16
42/75.03
2014/0263497 A1 * 9/2014 Visalli ..... F41C 33/0263
42/70.11
2014/0360077 A1 * 12/2014 Miller ..... F41G 1/387
42/84
2015/0253090 A1 * 9/2015 Kirchhoff ..... F41G 11/001
42/71.01
2015/0345896 A1 * 12/2015 Michal ..... F41C 23/16
42/75.01
2016/0169610 A1 * 6/2016 Hines ..... F41A 35/02
42/90
2016/0211095 A1 * 7/2016 Zimmer ..... H01H 9/0235
2016/0265871 A1 * 9/2016 Vallo ..... F41C 23/16
2016/0356567 A1 * 12/2016 Bybee ..... F41C 23/16
2017/0082399 A1 * 3/2017 Moore ..... F41G 1/35
2018/0010881 A1 * 1/2018 Garst ..... F41A 11/02
2018/0164071 A1 * 6/2018 Burgess ..... F41G 11/003
2018/0364008 A1 * 12/2018 Summerfield ..... F41G 1/44
2021/0018297 A1 * 1/2021 Swallow ..... A45F 5/02
2021/0270573 A1 * 9/2021 Verjovsky ..... F41C 23/22
2021/0391892 A1 * 12/2021 Ellena ..... H04L 12/10

* cited by examiner

COVER KIT FOR FIREARM HANDGUARD

FIELD OF THE DISCLOSURE

The present disclosure relates to a cover kit, and more particularly to a cover kit for a firearm handguard which enables to be detachably mounted on a slot of the firearm handguard and further guide electrical cables/wires at a desired direction.

BACKGROUND OF THE DISCLOSURE

Generally, firearms, particularly those providing for fast repeating firing action, may comprise handguard. The handguards usually provide the protection of dangerous areas of the firearms, as well as an improved grip for providing a better heat dissipation from a barrel of the weapons, wherein the conventional handguards provides a plurality of slots for not only providing the better heat dissipation, but also allow for mounting accessories.

One non-limiting example of the problems associated with mounting accessories, such as flashlights, is the cable management. Usually, the traditional cable management is to utilize tapes, glue or zips to tie the cables/wires on the handguard. However, this traditional method could not tightly secure the cables/wires, and the cables/wires will easily fall down from the firearm during the shooting operation.

To overcome this known problem, past solutions have involved developing a cable clip simply installed on the slot of the handguard in order to organize, control, and route electrical cables and wires. Even if the improved cable clip could secure the electrical cables and wires on the firearm, it could not sufficiently organize the electrical cables and wires while a plurality of electrical devices are utilized.

In another non-limiting example of the problems associated with the improved cable clip is that the above improved cable clip generally provide to guide the electrical cables and wires along one single direction; therefore, if more than one electrical devices are utilized, it will be a hassle to control or store all of them along the right direction.

There may exist a desire to develop a cable management kit which is compact in size, easy to install on the firearm, and also allow the cables and wires being tightly secured on the firearm along a plurality of selectable directions.

All referenced patents, applications and literatures are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The disclosed embodiments may seek to satisfy one or more of the above-mentioned desires. Although the present embodiments may obviate one or more of the above-mentioned desires, it should be understood that some aspects of the embodiments might not necessarily obviate them.

BRIEF SUMMARY OF THE DISCLOSURE

In a general implementation, a cover kit for a firearm handguard having a plurality of slots, the cover kit comprises a cover body having a bottom side detachably mounted on the slot of the firearm; fastening means for securing the cover on the firearm; a cable secured between the bottom side of the cover and the firearm; wherein the bottom side comprises a plurality of horizontal tunnels and a plurality of transversal tunnels intersected with the transversal tunnels; wherein the cable is embedded in at least one of transversal tunnels and/or the horizontal tunnels.

In another aspect combinable with the general implementation, the cover body is configured to completely cover one of the plurality of slots.

In another aspect combinable with the general implementation, the transversal tunnels are transversally extended through the cover body.

In another aspect combinable with the general implementation, the horizontal tunnels are horizontally extended through the cover body.

In another aspect combinable with the general implementation, the cable is passed through the cover body.

In another aspect combinable with the general implementation, the transversal tunnels are communicated with the horizontal tunnels.

In another aspect combinable with the general implementation, the cable is entered into the bottom side of the cover body through one of the transversal tunnels and then is exited from the cover body through either one of the horizontal tunnels or the other one of the transversal tunnels.

In another aspect combinable with the general implementation, the cable is entered into the bottom side of the cover body through one of the horizontal tunnels and then is exited from the cover body through either one of the transversal tunnels or the other one of the horizontal tunnels.

In another aspect combinable with the general implementation, the fastening means is located at a center of the cover body.

In another aspect combinable with the general implementation, the cover kit further comprises a front side and a rear side opposite of the front side, wherein the horizontal tunnels are integrally extended from the front side to the rear side of the cover body.

In another aspect combinable with the general implementation, the cover kit further comprises a right side and a left side opposite of the right side, wherein the transversal tunnels are integrally extended from the right side to the left side of the cover body.

In another aspect combinable with the general implementation, the cover kit further comprises a right side, a left side opposite of the right side, a front side, and a rear side opposite of the front side, wherein a length of the horizontal tunnel is defined between the front side and the rear side, and a length of the transversal tunnel is defined between the right side and the left side.

In another aspect combinable with the general implementation, the length of the horizontal tunnel is greater than the length of the transversal tunnel.

In another aspect combinable with the general implementation, the horizontal tunnels are spacedly arranged on the cover body.

In another aspect combinable with the general implementation, the transversal tunnels are spacedly arranged on the cover body.

In another aspect combinable with the general implementation, the horizontal tunnels are inwardly extended from the bottom side of the cover body.

In another aspect combinable with the general implementation, the transversal tunnels are inwardly extended from the bottom side of the cover body.

In another aspect combinable with the general implementation, one of the horizontal tunnels is communicated with the other one of the horizontal tunnels via the transversal tunnels.

In another aspect combinable with the general implementation, one of the transversal tunnels is communicated with the other one of the transversal tunnels via the horizontal tunnels.

In another aspect combinable with the general implementation, each one of the horizontal tunnels is parallel alignment with one another, and each one of the transversal tunnels is parallel alignment with one another.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above and below as acting in certain combinations and even initially claimed as such, one or more features from a claimed combination can in some cases be excised from the combination, and the claimed combination may be directed to a subcombination or variation of a subcombination.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

It should be noted that the drawing figures may be in simplified form and might not be to precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

DETAILED DESCRIPTION OF THE EMBODIMENTS

The different aspects of the various embodiments can now be better understood by turning to the following detailed description of the embodiments, which are presented as illustrated examples of the embodiments defined in the claims. It is expressly understood that the embodiments as defined by the claims may be broader than the illustrated embodiments described below.

The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

It shall be understood that the term "means," as used herein, shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

Figure 1:
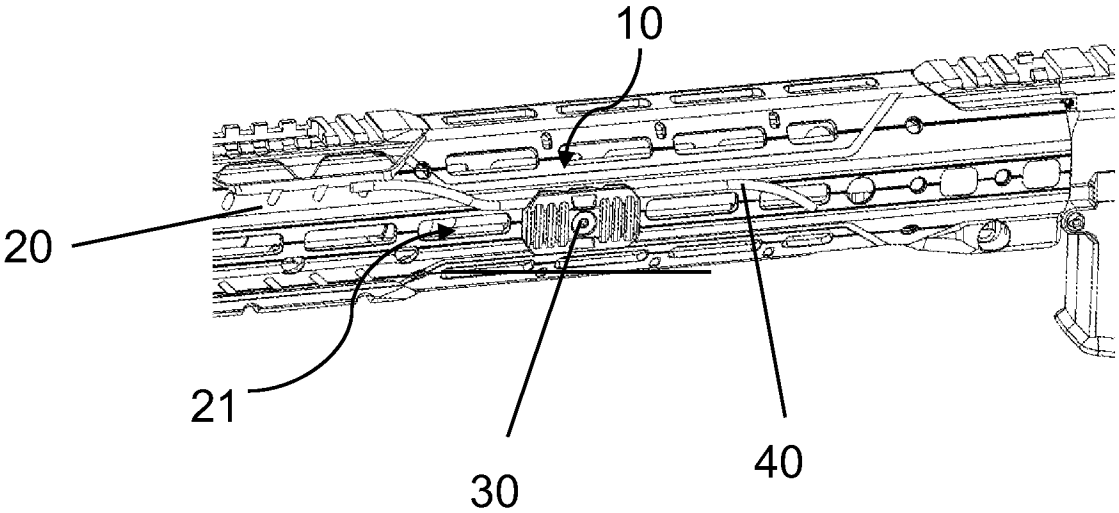
FIG. 1 is a perspective view of a cover kit for a firearm handguard according to an embodiment, illustrating a cover body being mounting on a slot of the firearm handguard.

FIG. 1 generally depicts a perspective view of a cover kit for a firearm handguard 20 having a plurality of slots 21 according to an embodiment.

Referring to FIG. 1, the cover kit comprises a cover body 10 which is configurated to directly be mounted on the firearm handguard 20, wherein the cover body 10 may be configurated to directly be mounted on the slot 21 of the firearm handguard 20. In an embodiment, the cover kit comprises fastening means 30 for securing the cover body 10 on the slot 21 of the firearm handguard 20 and a cable 40 secured between the cover body 10 and the firearm handguard 20. Here, the cover body 10 may be configured to completely cover one of the plurality of slots 21 or at least one of the slot 21.

In another embodiment, the cover body 10 may be configured to partially cover one or more than one of the slots 21 in order to secure the cover body 10 on the firearm handguard 20.

It is noted that the fastening means 30 may be a screw and a nut configurated to secure the cover body 10 on the slot 21 of the firearm handguard 20. In an embodiment, the screw may be passed through the slot 21 of the firearm handguard 20 and the cover body 10 in order to engage with the nut positioned on an interior surface of the firearm handguard 20.

Here, the cover body 10 and the handguard of the firearm 20 are sandwiched between the screw and the nut in order to mount the cover body 10 on the firearm handguard 20.

The contemplated fastening means can be various kinds of kits to tightly secure the cover body 10 on the firearm handguard 20, such kits may include a protrusion configurated to engage with an interior surface of the handguard 20, or all reasonable combinations thereof. Preferably, the protrusion is made of flexible material to enable the deformation and reinstatement.

Figure 2:
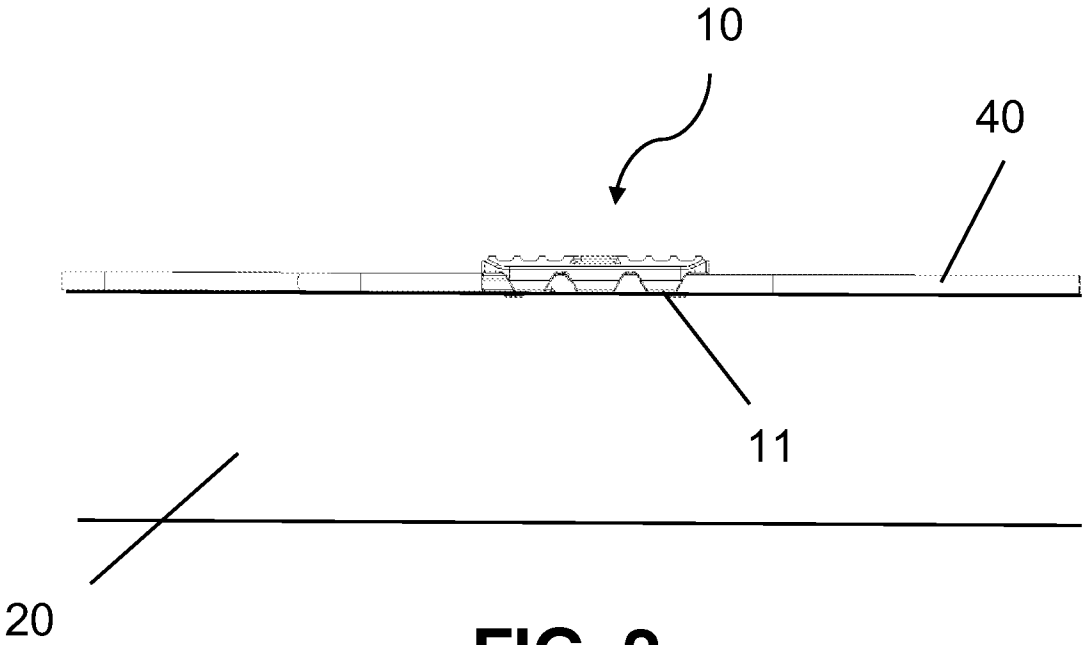
FIG. 2 is a side view of the cover kit of FIG. 1, illustrating the cover body being mounting on the firearm handguard.

FIG. 2 generally depicts a side view of the cover kit for the firearm handguard 20 according to the embodiment.

Referring to FIG. 2, the cover body 10 further comprises a bottom side 11 detachably mounted on the slot of the firearm handguard 20. Here, the cable 40 may be secured between the bottom side 11 of the cover body 10 and the firearm handguard 20.

Figure 3:
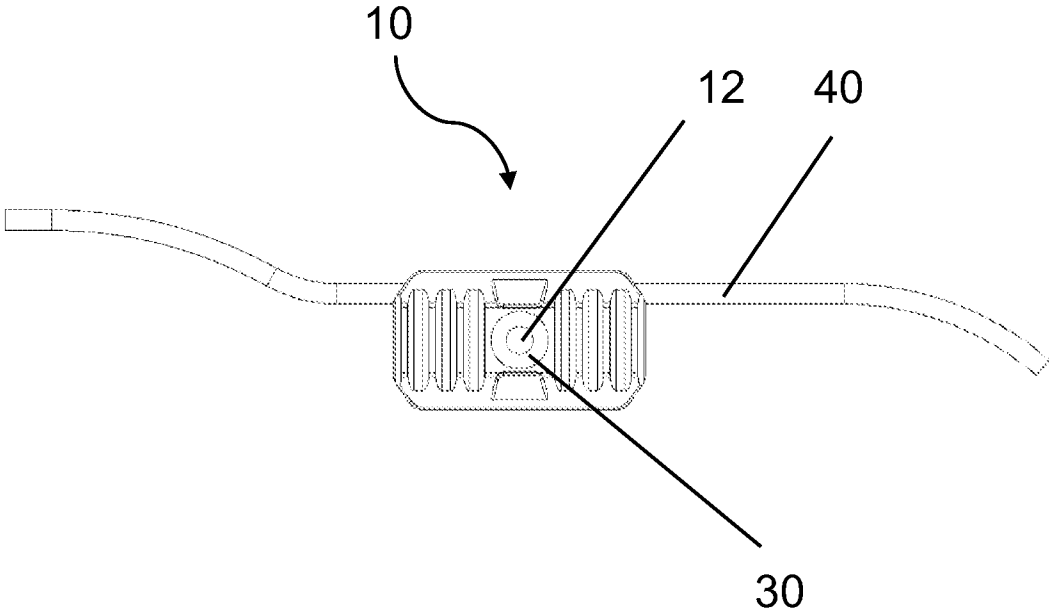
FIG. 3 is a top view of the cover kit for the firearm handguard according to the embodiment.

FIG. 3 generally depicts a top view of the cover kit for the firearm handguard 20 according to the embodiment.

Referring to FIG. 3, the cover body 10 further comprises a center (e.g., a locking hole 12) formed at a center of the cover body 10, wherein the fastening means 30 (e.g., the screw) may be passed through the center (e.g., the locking hole 12) of the cover body 10 to secure the cover body 10 on the firearm handguard 20. In an embodiment, the cover body 10 may be secured on the firearm handguard 20 along the center of the cover body 10 through the fastening means 30, as shown details in FIG. 1.

In an embodiment. The fastening means 30 may be positioned at the center 12 of the cover body in order to tightly fasten the cover body 10 on the firearm handguard 20.

FIGS. 4A-4F generally depicts bottom views of the cover kit for the firearm handguard according to the embodiment.

Figure 4A:
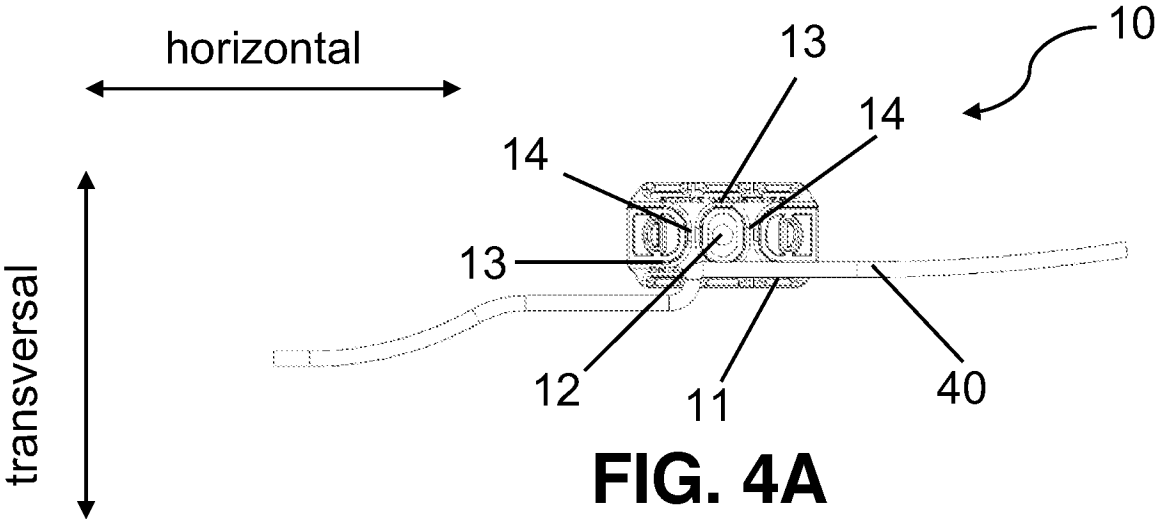
FIG. 4A is a bottom view of an embodiment of the cover kit for the firearm handguard according to an aspect of the embodiment.
Figure 4B:
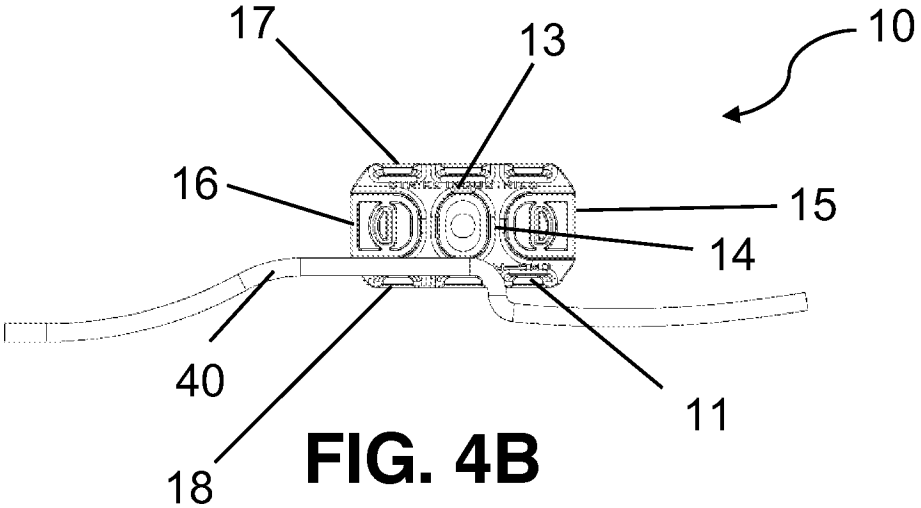
FIG. 4B is a bottom view of an embodiment of the cover kit for the firearm handguard according to another aspect of the embodiment.

Referring to FIGS. 4A-4B, the bottom side 11 of the cover body 10 comprises a plurality of horizontal tunnels 13 and a plurality of transversal tunnels 14 intersected with the transversal tunnels 14, wherein the cable 40 may be embedded in at least one of transversal tunnels 14 and/or the horizontal tunnels 13.

In an embodiment, the transversal tunnels 14 may be transversally extended through the cover body 10. Here, the transversal tunnels 14 may be formed in pair and positioned on two sides (e.g., a front hole side and a rear hole side opposite of the front side) of the center (e.g., locking hole 12) of the cover body 10.

In an embodiment, the horizontal tunnels 13 may be horizontally extended through the cover body 10. Here, the horizontal tunnels 13 may be formed in pair and positioned on another two side (e.g., a top hole side and a bottom hole side opposite of the top side hole) of the center (e.g., locking hole 12) of the cover body 11.

In an embodiment, the center (e.g., locking hole 12) may be encircled by the transversal tunnels 14 and the horizontal tunnels 13.

In an embodiment, a distance between the top hole side and the bottom hole side of the locking hole 12 may be greater than a distance between the front hole side and the rear hole side of the locking hole 12.

In an embodiment, the horizontal tunnels 13 may be spacedly arranged on the bottom side 11 of the cover body 10, wherein a pair of the horizontal tunnel may be spacedly arranged along the top hole side and the bottom hole side of the locking hole 12.

In an embodiment, the transversal tunnels 14 may be spacedly arranged on the bottom side 11 of the cover body 10, wherein a pair of the transversal tunnel 14 may be spacedly arranged along the front hole side and the rear hole side of the locking hole 12.

In an embodiment, a distance between the pair of the horizontal tunnel 13 may be greater than a distance between the pair of the transversal tunnel 14.

In an embodiment, each one of the horizontal tunnels 13 may be parallel alignment with one another, and each one of the transversal tunnels 14 may be parallel alignment with one another.

In an embodiment, the transversal tunnels 14 may be communicated with the horizontal tunnels 13. Here, each of the transversal tunnels 14 may be communicated with one another through the horizontal tunnels 13. Here, each of the horizontal tunnels 13 may be communicated with one another through the transversal tunnels 14.

In an embodiment, the horizontal tunnels 13 may be inwardly extended from the bottom side 11 of the cover body 10, and the transversal tunnels 14 may be inwardly extended from the bottom side 11 of the cover body 10, as shown details of FIG. 2.

It is noted that the bottom side 11 of the cover body 10 may be inwardly extended to form the horizontal tunnels 13 and the transversal tunnels 14, wherein the horizontal tunnels 13 and the transversal tunnels 14 may be configured to accommodate the cable 40. Here, the cable 40 may be selectively embedded inside the horizontal tunnels 13 and/or the transversal tunnels 14 in order to guide the cable 40 towards a desired direction. In an embodiment, the cable 40 may be selectively embedded inside only a partial horizontal tunnel 13 and/or only a partial transversal tunnel 13.

Referring to FIGS. 4A to 4F, the cable 40 may be passed through the cover body 10 through the horizontal tunnels 13 and/or the transversal tunnels 14.

Continuing to FIG. 4A, the cable 40 may be entered into the bottom side 11 of the cover body 10 through one of the transversal tunnels 14 and may be embedded inside one of the horizontal tunnels 13, and then may be bent to exit the cover body 10 through the one of the horizontal tunnels 13.

Continuing to FIG. 4B, the cable 40 may be entered into the bottom side 11 of the cover body 10 through one of the horizontal tunnels 13 and may be embedded inside the one of the horizontal tunnels 13, and then may be bent to exit the cover body 10 through one of the transversal tunnels 14.

Figure 4C:
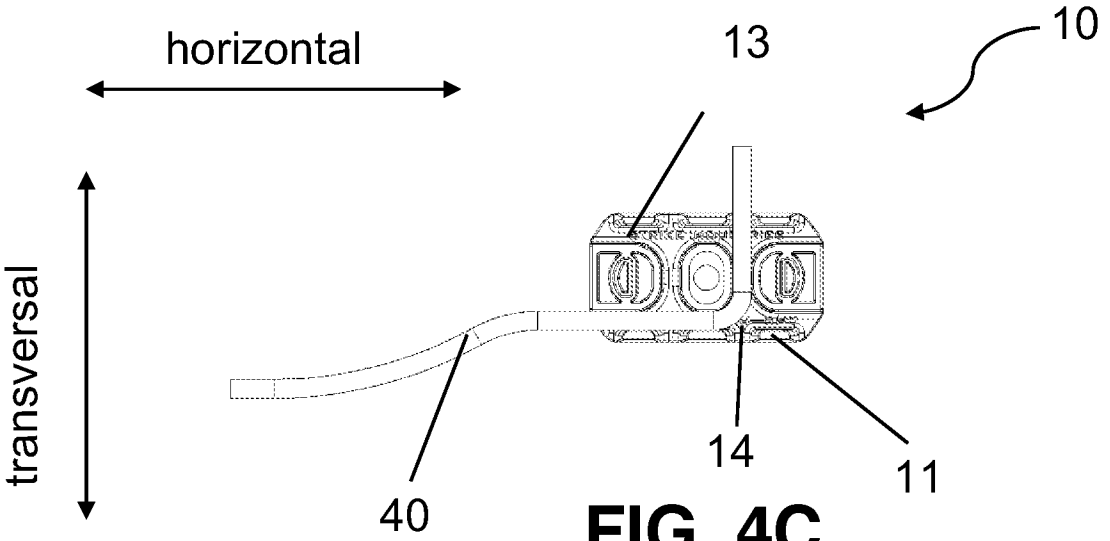
FIG. 4C is a bottom view of an embodiment of the cover kit for the firearm handguard according to still another aspect of the embodiment.

Continuing to FIG. 4C, the cable 40 may be entered into the bottom side 11 of the cover body 10 through one of the horizontal tunnels 13 and may be embedded inside the one of horizontal tunnels 13 and be bent to be embedded inside one of the transversal tunnels 14, and then may exit the cover body 10 through the one of the transversal tunnels 14.

Figure 4D:
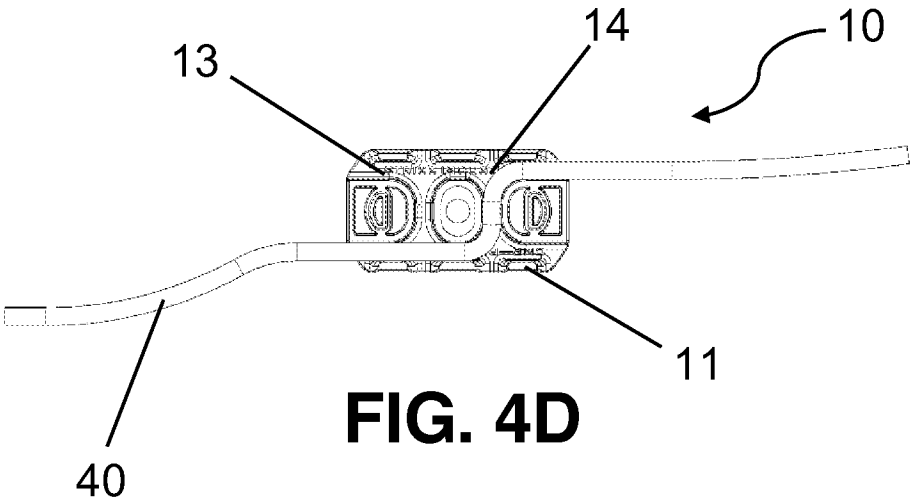
FIG. 4D is a bottom view of an embodiment of the cover kit for the firearm handguard according to still another aspect of the embodiment.

Continuing to FIG. 4D, the cable 40 may enter into the bottom side 11 of the cover body 10 through one of the horizontal tunnels 14 and may be embedded inside the one horizontal tunnels 14 and may be bent to be embedded inside one of the transversal tunnels 14, and then may be bent again to be embedded inside the other one of the horizontal tunnels 14 and exit the cover body through the other one of the horizontal tunnels 14.

Figure 4E:
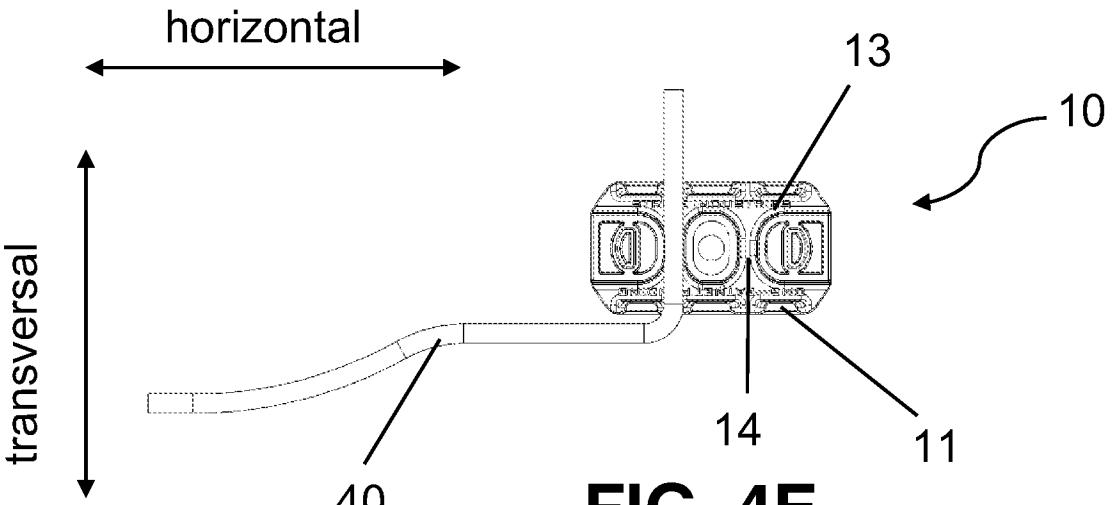
FIG. 4E is a bottom view of an embodiment of the cover kit for the firearm handguard according to still another aspect of the embodiment.

Continuing to FIG. 4E, the cable 40 may enter into the bottom side 11 of the cover body 10 through one of the transversal tunnels 14 and may be embedded inside the one of the transversal tunnels 14, and then may exit from the cover body 10 through the same one of the transversal tunnels 13.

Figure 4F:
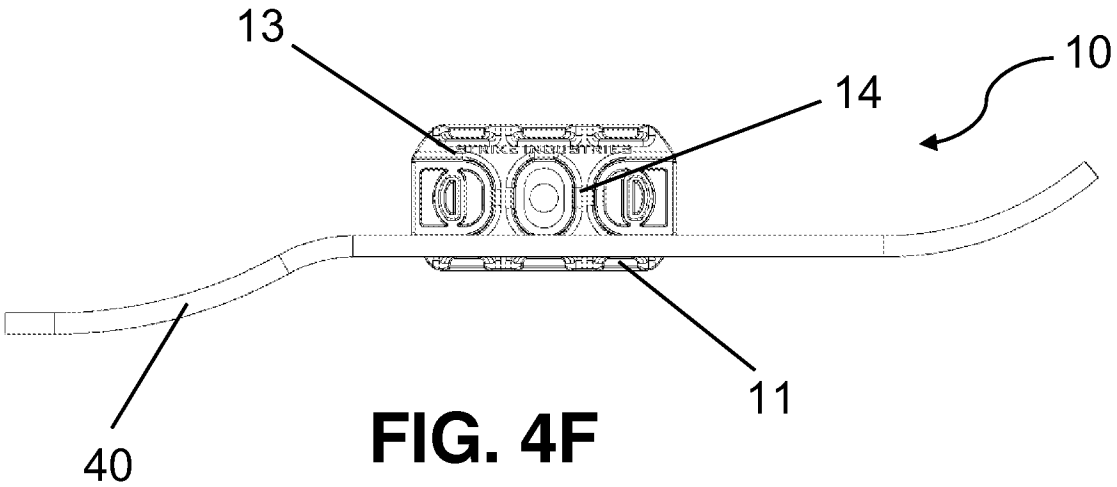
FIG. 4F is a bottom view of an embodiment of the cover kit for the firearm handguard according to still another aspect of the embodiment.

Continuing to FIG. 4F, the cable 40 may enter into the bottom side 11 of the cover body 10 through one of the horizontal tunnels 13 and then may exit from the cover body 10 through the same one of the horizontal tunnels 13.

It should be noted that the cable 40 may be in contact with at least one side (e.g., the top hole side, the bottom hole side, the front hole side, or the rear hole side) of the center (e.g., the locking hole 12) of the cover body 10 while the cable 40 is secured under the bottom side 11 of the cover body 10.

It should be understood that the above-described and embodiments illustrated of FIGS. 4A to 4F are exemplary and any other designs can be adopted in various embodiments of this disclosure.

As shown in FIGS. 4A-4F, the cover body 10 further comprises a front side 15 and a rear side 16 opposite of the front side 15, wherein the horizontal tunnels 13 may be integrally extended from the front side 15 to the rear side 16 of the cover body 10.

In an embodiment, the cover body 10 further comprises a right side 17 and a left side 18 opposite of the right side 17, wherein the transversal tunnels 14 may be integrally extended from the right side 17 to the left side 18 of the cover body 10.

It is noted that a length of the cover body 10 may be defined between the front side 15 and the rear side 16 of the cover body 10, and a width of the cover body 10 may be defined between the right side 17 and the left side 18 of the cover body 10, wherein the length of the cover body 10 may be greater than the width of the cover body 10.

In an embodiment, a length of the horizontal tunnel 13 is defined between the front side 15 and the rear side 16 of the cover body 10, and a length of the transversal tunnel 14 is defined between the right side 17 and the left side 18 of the cover body 10. Here, the length of the horizontal tunnel 13 may be greater than the length of the transversal tunnel 14.

In an embodiment, the horizontal tunnels 13 may be formed adjacent to the right side 17 and/or the left side 18 of the cover body 10, and the transversal tunnels 14 may be formed adjacent to the center (e.g., the locking hole 12) of the cover body 10.

The contemplated cover body 10 can be made of suitable materials to withstand temperature extreme and the chemical environment and to be bendable for mounting on the firearm handguard, such materials include natural and synthetic polymers, various metals and metal alloys, naturally occurring materials, glass and ceramic materials, sol-gel materials, and all reasonable combinations thereof.

Many alterations and modifications may be made by those having ordinary skill in the art without departing from the spirit and scope of the disclosed embodiments. Therefore, it must be understood that the illustrated embodiments have been set forth only for the purposes of example and that it should not be taken as limiting the embodiments as defined by the following claims. For example, notwithstanding the fact that the elements of a claim are set forth below in a certain combination, it must be expressly understood that the embodiment includes other combinations of fewer, more or different elements, which are disclosed herein even when not initially claimed in such combinations.

Thus, specific embodiments and applications of the cover kit for the firearm handguard have been disclosed. It should be apparent, however, to those skilled in the art that many more modifications besides those already described are possible without departing from the disclosed concepts herein. The disclosed embodiments, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the embodiments. In addition, where the specification and claims refer to at least one of something selected from the group consisting of A, B, C . . . and N, the text should be interpreted as requiring at least one element from the group which includes N, not A plus N, or B plus N, etc.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

What is claimed is:

1. A cover kit for a firearm handguard having a plurality of slots, the cover kit comprising:

a cover body having a bottom side detachably mounted on the firearm handguard;

fastening means for securing the cover body on the firearm handguard;

a cable fastened between the bottom side of the cover body and the firearm handguard;

wherein the bottom side comprises a plurality of first tunnels and a plurality of second tunnels intersected with the plurality of the first tunnels;

wherein the cable is embedded in at least one of first tunnel and/or the second tunnels;

wherein the cover body comprises a locking hole formed on a center of the cover body; wherein the locking hole is encircled by the first tunnel and the second tunnel; wherein the fastening means comprises a screw passed through one of the pluralities of the slots and the locking hole and a nut positioned on an interior surface of the firearm handguard to engage with the screw; wherein the cover body and the firearm handguard are sandwiched between the screw and the nut to mount the cover body on one of the plurality of the slots of the firearm handguard.

2. The cover kit of claim 1, wherein the cover body is configured to completely cover one of the plurality of slots.

3. The cover kit of claim 1, wherein the second tunnels are transversally extended through the cover body.

4. The cover kit of claim 1, wherein the first tunnels are horizontally extended through the cover body.

5. The cover kit of claim 1, wherein the cable is passed through the cover body.

6. The cover kit of claim 1, wherein the second tunnels are communicated with the first tunnels.

7. The cover kit of claim 1, wherein the cable is entered into the bottom side of the cover body through one of the second tunnels and then is exited from the cover body through one of the first tunnels or the other one of the second tunnels or the one of the second tunnels.

8. The cover kit of claim 1, wherein the cable is entered into the bottom side of the cover body through one of the first tunnels and then is exited from the cover body through one of the second tunnels or the other one of the first tunnels or the one of the first tunnel.

9. The cover kit of claim 1, wherein the cover body further comprises a front side and a rear side opposite of the front side, wherein the first tunnels are integrally extended from the front side to the rear side of the cover body.

10. The cover kit of claim 1, wherein the cover body further comprises a right side and a left side opposite of the right side, wherein the second tunnels are integrally extended from the right side to the left side of the cover body.

11. The cover kit of claim 1, wherein the cover body further comprises a right side, a left side opposite of the right side, a front side, and a rear side opposite of the front side, wherein a length of one of the plurality of the first tunnel is defined between the front side and the rear side, and a length of one of the plurality of the second tunnel is defined between the right side and the left side.

12. The cover kit of claim 11, wherein the length of one of the plurality the first tunnel is greater than the length of one of the plurality of the second tunnel.

13. The cover kit of claim 1, wherein the first tunnels are spacedly arranged on the cover body.

14. The cover kit of claim 1, wherein the second tunnels are spacedly arranged on the cover body.

15. The cover kit of claim 1, wherein the first tunnels are inwardly extending from the bottom side of the cover body.

16. The cover kit of claim 1, wherein the second tunnels are inwardly extended from the bottom side of the cover body.

17. The cover kit of claim 1, wherein one of the first tunnels is communicated with the other one of the first tunnels via at least one of the second tunnel.

18. The cover kit of claim 1, wherein one of the second tunnels is communicated with the other one of the second tunnels via a pair of first tunnels.

19. The cover kit of claim 1, wherein each one of the first tunnels is parallel alignment with one another, and each one of the second tunnels is parallel alignment with one another.

* * * * *